US006412540B2

(12) United States Patent
Hendee

(10) Patent No.: US 6,412,540 B2
(45) Date of Patent: Jul. 2, 2002

(54) STRUCTURAL PROTECTIVE WINDSCREEN

(75) Inventor: Charles C. Hendee, Missouri City, TX (US)

(73) Assignee: Hendee Enterprises, Inc., Houston, TX (US)

( * ) Notice: Subject to any disclaimer, the term of this patent is extended or adjusted under 35 U.S.C. 154(b) by 0 days.

(21) Appl. No.: 09/862,361

(22) Filed: May 22, 2001

Related U.S. Application Data

(60) Provisional application No. 60/206,670, filed on May 24, 2000.

(51) Int. Cl.[7] ..... A47H 23/00

(52) U.S. Cl. ..... 160/327; 160/330; 160/349.1; 52/202; 52/DIG. 12

(58) Field of Search ..... 160/327, 349.1, 160/330; 52/202, 63, DIG. 12, 23

(56) References Cited

U.S. PATENT DOCUMENTS 2,136,042 A * 11/1938 Cornell et al.
3,715,843 A * 2/1973 Ballinger
5,579,794 A * 12/1996 Sporta
5,787,955 A * 8/1998 Dargie
5,791,090 A * 8/1998 Gitlin et al.
5,915,449 A * 6/1999 Schwartz
6,176,050 B1 * 1/2001 Gower

* cited by examiner

*Primary Examiner*—Blair M. Johnson
(74) *Attorney, Agent, or Firm*—Buskop Law Group, P.C.; Wendy Buskop

(57) ABSTRACT

An apparatus, a windscreen, and method for securing a structure against damage from high winds, wherein the windscreen is engagable with a track with slidable, adjustable connectors such as eyebolt connectors or fixed pin connectors that is secured to the eaves or sides of a house, and, with a coarse fabric such as the sheet attached to the track with strap like elements and connectors and anchoring device for securing the windscreen to the ground preventing damage to the structure.

30 Claims, 8 Drawing Sheets

SECTION @ WALL

FIGURE 1 – SECTION @ WALL

STRUCTURAL PROTECTIVE WINDSCREEN

This application claims priority to provisional patent application Serial No. 60/206,670, filed with the United States Patent and Trademark Office on May 24, 2000.

The present invention relates generally to a protective windscreen which is attachable to buildings, particularly, the wall or soffit above windows and doors of a building. More particularly, it is an apparatus for securing a protective fabric to a roof at the eaves to protect the structure against wind and flying debris, particularly hurricane force winds.

BACKGROUND OF THE INVENTION

There has long been a need for protecting buildings against winds and flying debris that arise during hurricanes, and other storm conditions. There are several modes of destruction of structures by very high winds, including: (1) a lifting of roof parts, or other parts, usually on the leeward side followed by collapse due to wind pressures; (2) bit by bit destruction due to loss of roof corners, edges, overhangs, or projecting parts on any side; (3) breaking windows; (4) partial loss of wall integrity resulting in water damage internally to a structure, and (5) destruction of the building envelope from glass breakage resulting in wind and water damage. Further, wind pressure on doors jeopardizes safe entrance and exit of fire stations, shelter facilities, hospitals and command centers.

Earliest efforts to address this need include securing windows with plywood. To our knowledge, there has not been an adequate way of protecting entrances from wind pressure allowing egress.

The present invention is an easy to use windscreen, or hurricane protection device which can be easily put up or taken down which provides the advantages of securing windows and doors, while protecting the integrity of a structure from water, as well as protecting a structure from breakage of windows due to flying debris.

Current systems include plywood, corrugated metal, and roller shutters. These systems do not allow applicable protection to large expanses of glass or large doors. As they mount directly to walls, they do not allow egress behind them, which is desirable at entries and exits.

Accordingly, the present invention has been developed which does not use individual anchors on the building to secure attachment of screen, but uses a track system which provides a more shared load across more space than the traditional anchored windscreens. Attaching loops on tags and straps on bottom are placed in from edge allowing space for securing and cinching while leaving a skirt of screen to provide full coverage.

SUMMARY OF THE INVENTION

The object of the present invention is to provide an apparatus and method for protecting a building, a house, and other structures against damaging winds and flying debris utilizing a track, porous fabric sheet, slideable connectors and anchoring means to the ground.

A further object of the present invention is to provide adjustable protection for the structure against damage from wind-borne objects that might otherwise be driven against the building by enabling the fabric sheet to be angled from the building at a wide choice of angles.

The invention utilizes strap like webbing sewn into the fabric sheet, reinforcing the connectors to the track, and providing connections for anchoring the sheet, such as to the ground, forming a protective "windscreen." The windscreen sheet is preferably a commercially available knit or woven polyethylene or polypropylene fabric, other similar coarse fabric ("the sheet"), but may be vinyl coated mesh fabric, a strong polymer base fabric, a laminated fabric, or combinations thereof.

A further benefit of the invention is that the sheet will stop debris from contacting the vertical surfaces of the structure and yet have ease of installation and take down which enable the windscreen to be installed by only one person.

BRIEF DESCRIPTION OF THE DRAWINGS

The features of the invention are set out in the following with a specific reference to the accompanying drawings, in which the same characters of reference are employed to identify corresponding parts.

DETAILED DESCRIPTION OF THE PREFERRED EMBODIMENTS

The present invention is a flexible, porous wind protection system. The present invention, when installed, permits light to flow into a building as well as some wind penetration. The present invention is flexible and easy to store and folded, taking minimal space. The actual windscreen needs no maintenance, and the track for carrying the wind screen, made from aluminum, has no need for any maintenance.

The present invention provides a barrier which is light, and weighs approximately only 0.5 pounds per square yard. It is resistant to degradation in the presence of ultraviolet light and is resistant to mold and fungus growth. It can be wiped clean with a damp cloth. It can be used to cover doors, glass walls, porches, overhead doors, garage doors, windows, and vents in buildings. Preferably the invention can survive impacts which are at least 5 times the required impact anticipated in a Category 5 hurricane.

In the most preferred embodiment, the invention includes a track onto which slidable connectors are installed. A fabric sheet, preferably capable of resisting wind forces of 140 mph, and restricting the flow of air through the sheet to about 3 mph is desired is attached to the slidable connected and anchored to the ground using webbing.

In use, the invention should be able to deflect damaging flying debris and dissipate impact energy rather than damaging the structure.

The present invention can be installed vertically or at an angle. Entranceways can be left open until the last minute with the invention installed.

Figure 1:
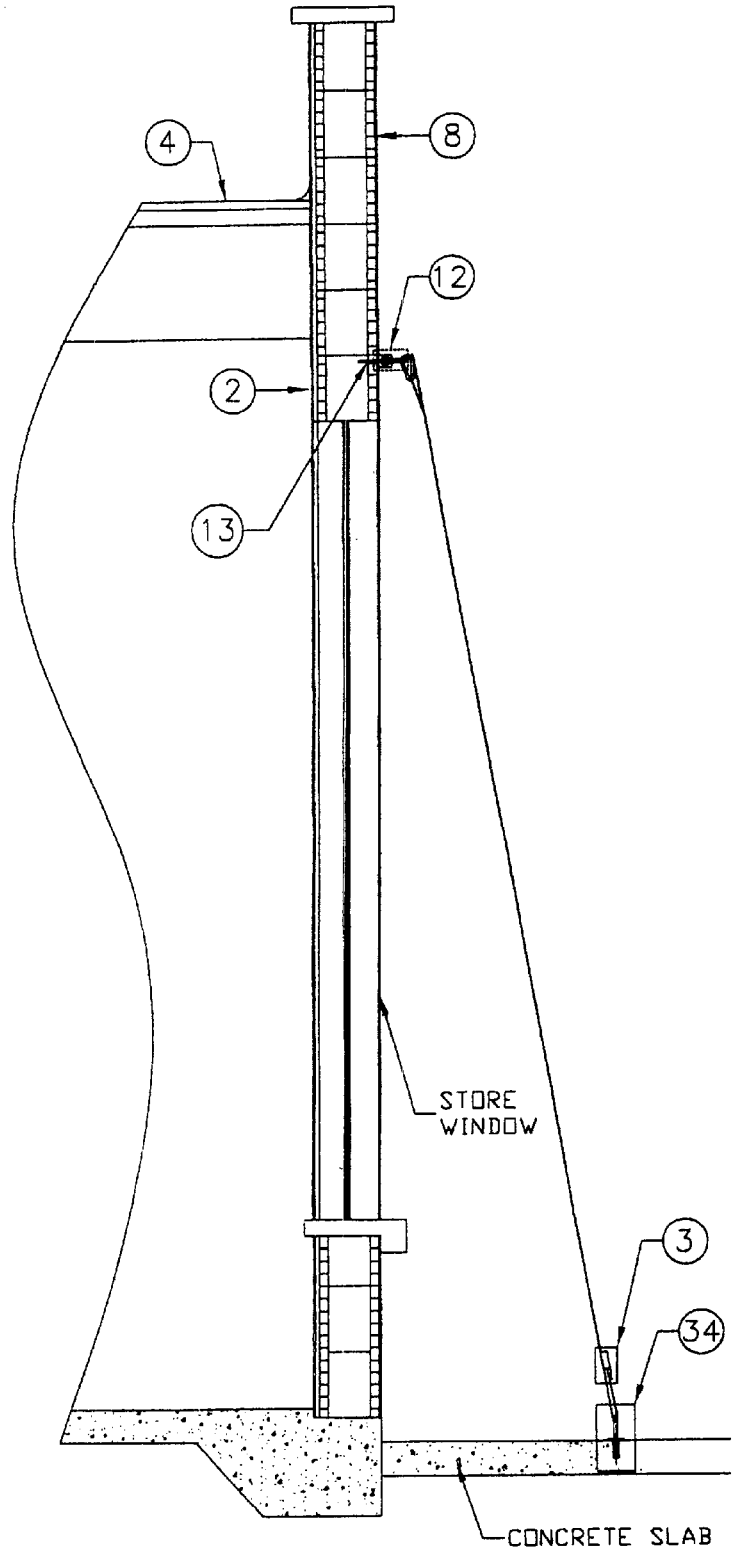
FIG. 1 is a cross section view of a building with the track installed and the protective sheets attached.
Figure 2:
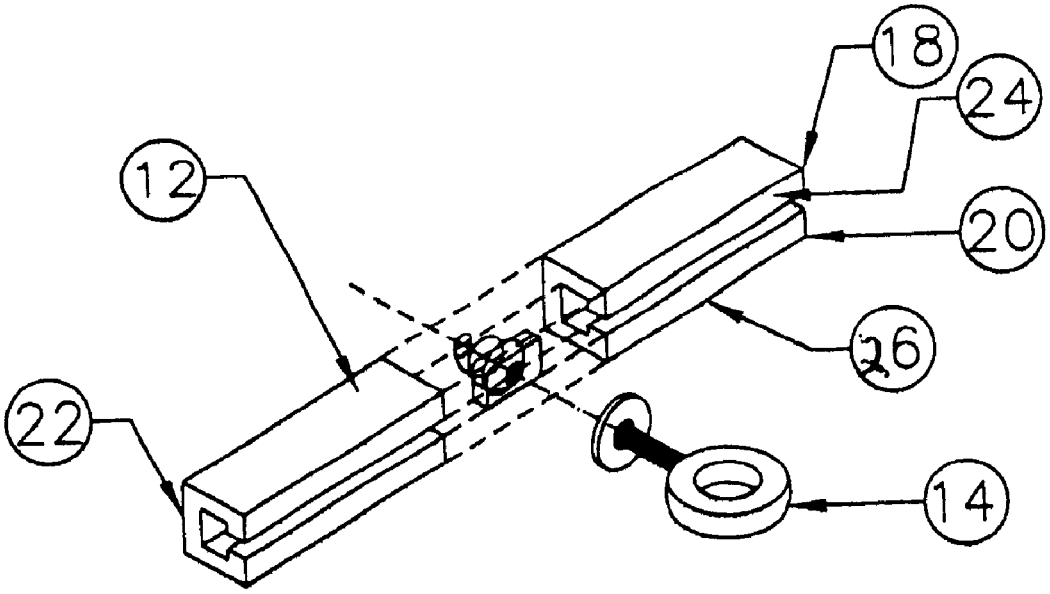
FIG. 2 is a perspective view of the track of the windscreen.

Referring initially to FIG. 1 and FIG. 2, a structure 2 is shown in FIG. 1 including a roof 4, and sidewalls 8.

Stretching along the wall 8 is a track 12 into which pluralities of connectors 14 (FIG. 2) are inserted. These connectors 14 may be fixed or slideable in the track and can be fixed pin connectors or eyebolt connectors. The connectors 14 can be permanently installed in the track 12 or can be removably inserted into the track just prior to installing the fabric sheet 16. The track 12 is preferably made from an aluminum alloy, or similar lightweight metal, which can be secured, attached to the house. In the most preferred embodiment, it is preferred embodiment that the track is removable and attachable to the house eaves, however, permanent installation is also considered within the scope of the present invention. FIG. 1 shows the track can be a metal angle with holes 13 to accept fasteners to attach the track to the house.

In the most preferred embodiment, the track 12 is of a shape, which is shown in FIG. 2. FIG. 2 shows a first edge 18, a second edge 20, and a back 22. The back of the track is installed into the building itself, such as with fasteners such as screws shown in FIG. 1 reference 13 or strong latches (not shown). The first edge 18 has a front portion 24 creating an edge of the track and the second edge 20 has a front portion 26, which is a mirror image of the first portion 24 of first edge 18.

It is considered within the scope of the present invention that the track preferably is extruded aluminum; however, it could be any metal, such as a laminated metal, or a graphite composite, or fiberglass, essentially, any strong material, capable of sustaining Category 5 hurricane winds without snapping or twisting and capable of resisting rusting or degradation due to exposure to the elements, including heat or cold. The track can be a continuous track all around the structure, or it could be a series of track segments. The track can be attached to a transitional edge, such as the edge of a roof on a house, or a non-transitional point, such as a point mid-way up the side of a parking garage. If the track is desired to be on a roof, it could be installed on the soffit or facia of a house. For the purpose of this application, the track is attachable to the edge of a building where "edge" is now defined as a vertical or horizontal structurally sound exterior surface.

Although the present invention is contemplated for use with hurricanes, it is considered that this invention is also usable with heavy snows or mudslide issues. It is also possible, that with the application of fire resistant chemicals, the present invention could assist in protecting houses from flying flames during forest fires or the wild fire which occur in California and other dry or drought stricken areas.

Figure 3:
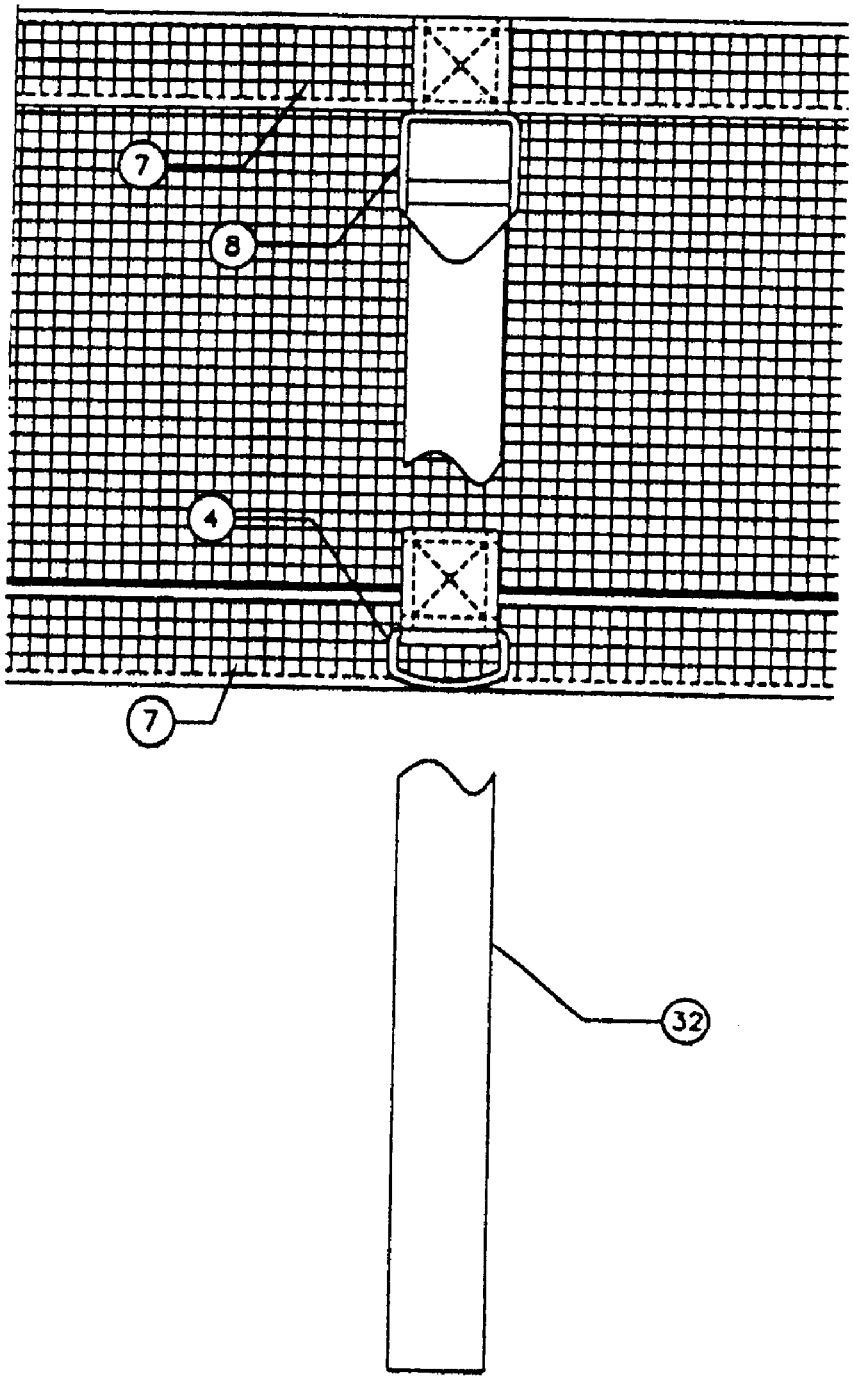
FIG. 3 shows the tensioning means for securing the fabric sheet to tie down loops.

FIG. 3 shows the anchor means with tensioning means 8, reinforcing webbing 7 with base loops 4 for engaging anchoring loops 32.

Figure 4:
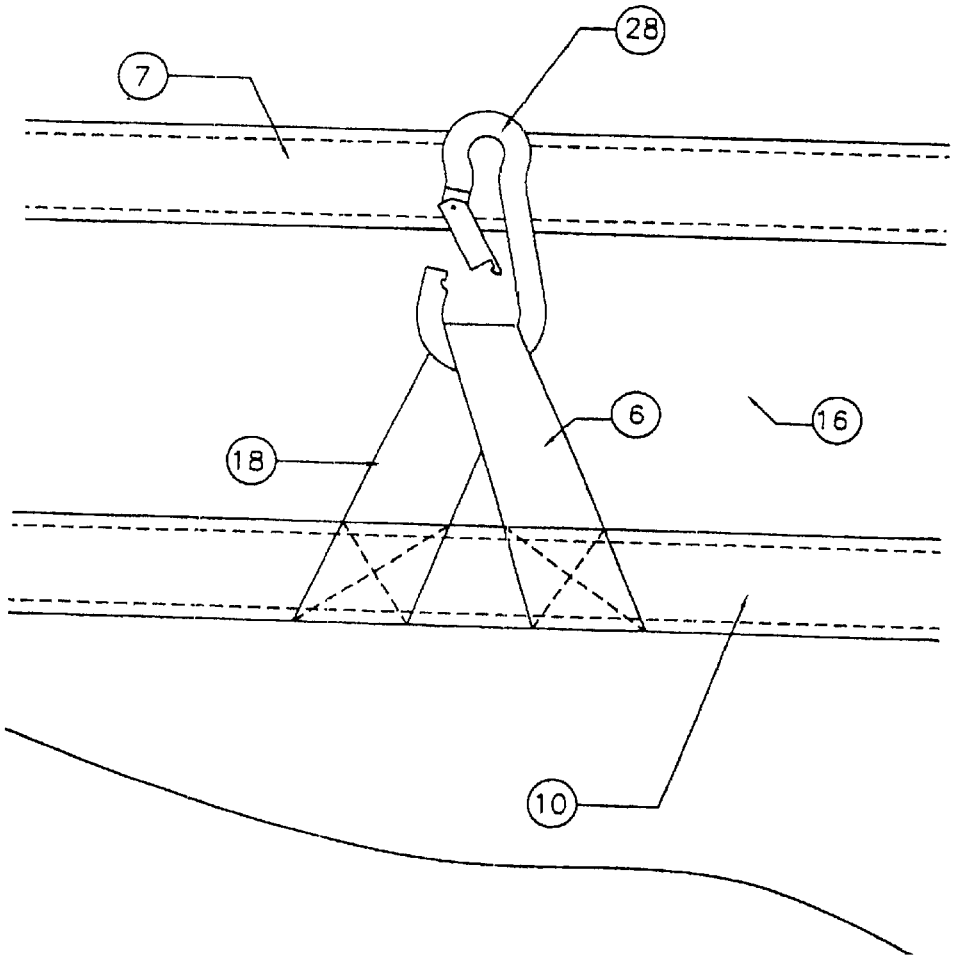
FIG. 4 is a detailed view of the fastener secured to the fabric sheet.
Figure 5:
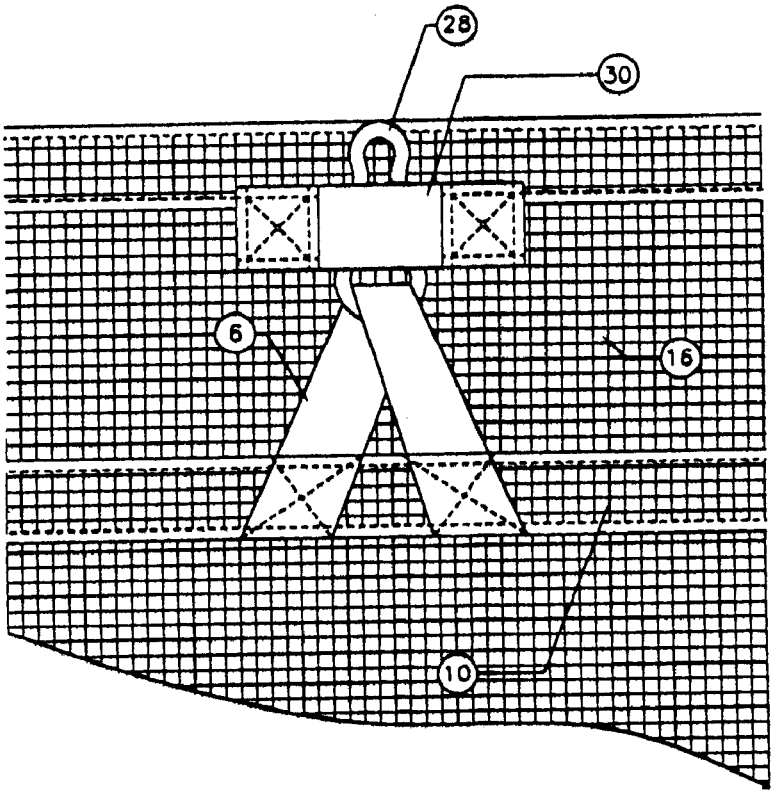
FIG. 5 is a detailed view of the fastener secured to the fabric sheet with the web strap over the connector.

FIGS. 4 and 5 show the connectors 14 are firmly engaged with the track. Connectors 14 in the most preferred embodiment are sliding eyebolts, having a loop shape with a stem, but these connectors could also be of other shapes. The connectors 14 must be very strong and capable of engaging the track 12 on one end and fasteners on the other end. Connector 14 can also be non-sliding pins mounted vertically in the track. Track 12 can then be engaged with the pins to support the fabric sheet 16. Connectors 14 are preferably metal but could be made from a plastic material as well.

Referring to FIGS. 4 and 5 a plurality of attaching loops 6 are securely sewn into fabric sheet 16. Fastener 28 can engage the attaching loops 6 and secure the fabric sheet 16 to connectors 14. In an alternative embodiment, the attaching loops 6 could be directly secured to connectors 14, depending on the shape of the slidable connectors, and whether the connectors are additionally lockable. The fastener 28 can be a spring loaded locking fastener, a d-ring fastener, or a simple metal loop. Alternative high strength graphite composites or strong polymer laminate materials could be used as fasteners 28.

A secure covering such as a web strap 30 can be placed over the fastener 28 to provide more control, and decrease the ability for wind to rip the connectors from the attaching loops 6. In the most preferred embodiment, the secure covering is webbing.

Webbing 10 is attached to the fabric sheet 16 to reinforce the sheet. In addition the same webbing can be used with buckles 8 shown in FIG. 3 to form anchoring means, which is adjustable. The webbing 10 is preferably a strong, polymer, which is also capable of resisting UV degradation and fungus build up.

Although any strong fabric will serve as fabric 16, in the preferred embodiment of the invention, fabric 16 will be made of a coarsely knit or woven material. Desirable qualities for such fabric include a uniform open weave or knit that will allow the passage of air through the fabric, and construction from material that is flexible, ultraviolet and temperature resistant, strong, and of low cost. Commercially available knit or woven polyethylene or polypropylene fabric possesses all these desirable qualities and comes in various degrees of thickness and weaves and percentages of opaque threads woven into the fabric, and in percentages of porosity of the fabric. The most preferred embodiment of the present invention uses a cloth with a tight weave and low porosity to light. Vinyl coating mesh, polyester or other polymer base fabric could also be used within the scope of the present invention.

Figure 6:
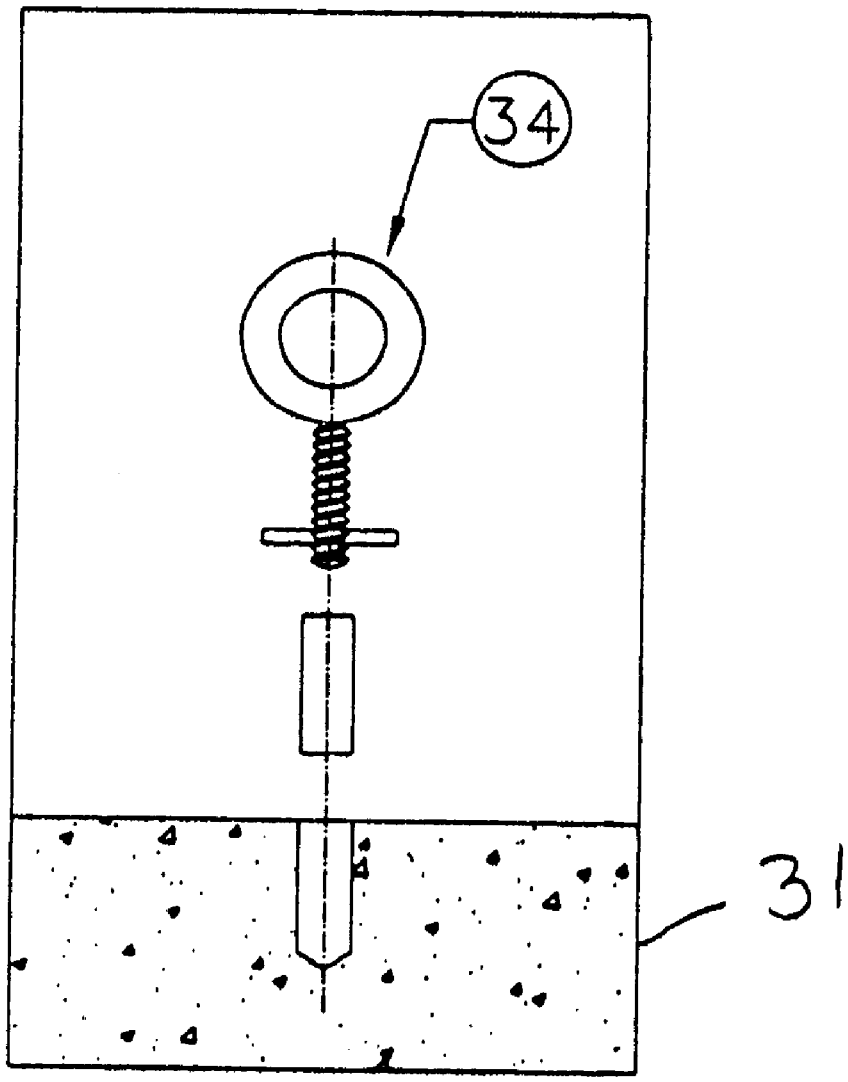
FIG. 6 is an enlarged view of the eyebolt used to anchor the invention is concrete.

Shown in FIG. 6 in this embodiment of the invention tensioning means 8 attach to tie down loops 32 which can be anchored to eyebolts 34. The anchor is embedded in the concrete slab 31. In an alternative anchoring system, the anchoring means can attach to ground with tie down loops 32 secured to the ground anchors through which tensioning means 8 and loops can pass.

The spacing of the anchor assemblies is preferably one per twenty-four (24) square feet of structure, with the spacing of the tie-down loops approximately two feet apart. Webbing strap assemblies are placed on two-foot centers along length of sheet for securing sheet to anchors 34. The tensile strength of the webbing is preferably a minimum of 3000 pounds.

Figure 7:
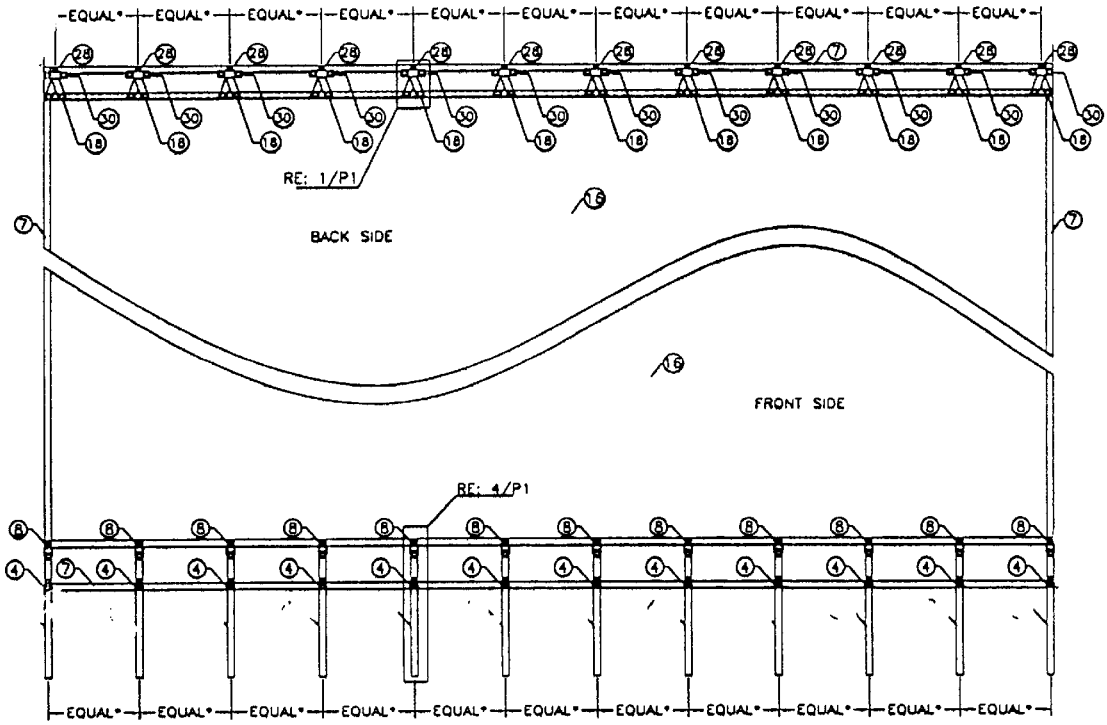
FIG. 7 shows a top view of the backside and front side for the invention.

FIG. 7 shows a top view of the invention with fabric secured to the roof track.

Figure 8:
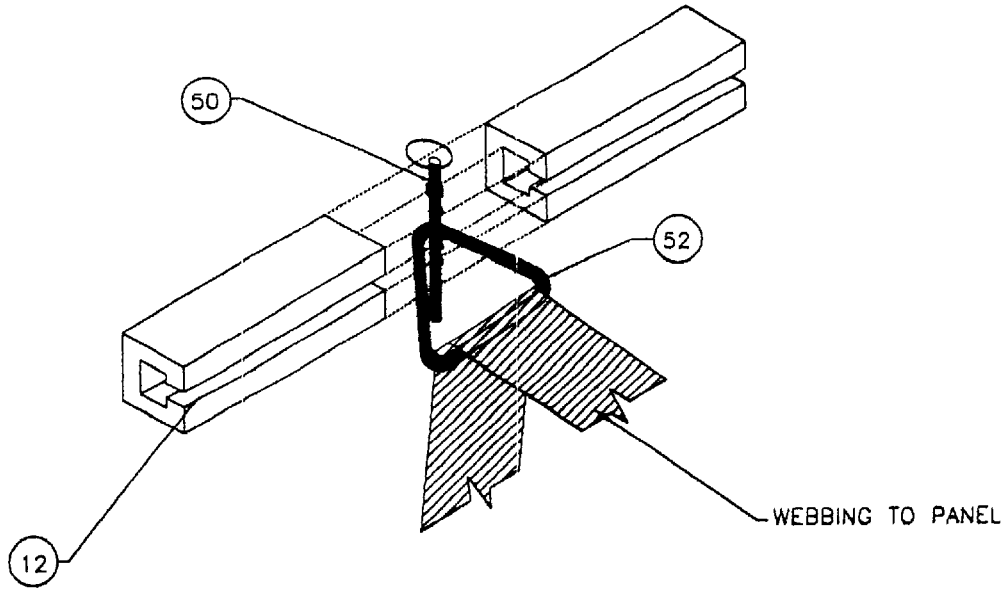
FIG. 8 shows a view of the pin connector of the invention.

FIG. 8 shows the track 12 with the pin 50 extending through track 12 and fastener 52 engaging the pin 50.

On certain larger structures the weight of the windscreen fabric is too great to allow easy installation. In one embodiment of the invention, the material can then be permanently attached to the building and like a giant curtain be slidable into a compartment located on the side of the building for storage. Known curtain storage assemblies, such as for theaters could be used and are incorporated herein by reference.

What is claimed is:

1. A screen for protecting a building comprising:

a. track attachable to an edge of a building;

b. a sheet of fabric having first and second opposed edges and a porosity such that air and light will pass through the fabric;

c. a plurality of slidable eye bolt connectors for engaging in said track at one end and engaging a fastener at the other end;

d. webbing strips affixed to said sheet adjacent said first edge of said opposed edges at a first end and providing loops of webbing strips at a second end;

e. said fastener connected to the loops of webbing strip and removably engagable with the slidable eye bolt connectors; and f. webbing anchoring strips secured to said sheet adjacent said second edge and attached to fixed anchoring means.

2. The screen according to claim 1, wherein said sheet is a coarsely woven fabric of uniform open weave and the woven fabric is selected from the group comprising: polyethylene, polypropylene, vinyl coating mesh, polyester, other polymer base fabrics, laminates and combinations thereof.

3. The screen according to claim 1, wherein the sheet of fabric extends from the edge of the track to the ground.

4. The screen according to claim 1, wherein said webbing anchoring strips are spaced from the edge of said sheet.

5. The screen according to claim 1, wherein said track is a metal angle with holes to accept fasteners to attach the track to the building.

6. The screen according to claim 1, wherein the loops of webbing strips are spaced from the edge of said sheet of fabric.

7. The screen according to claim 1, wherein said building is a house and said track engages a soffit or a facia of said house.

8. The screen according to claim 1, further comprising reinforcing webbing affixed to said sheet to carry load from said plurality of slidable eye bolt connectors.

9. The screen according to claim 1, wherein said anchoring means are earth or concrete anchors for attaching to said webbing anchoring strips.

10. The screen according to claim 1, wherein the fastener is a lockable connector.

11. The screen according to claim 10, wherein the lockable connector is spring loaded locking fastener.

12. The screen according to claim 1, wherein a band of reinforcing webbing material covers the fastener.

13. The screen according to claim 1, further comprising a plurality of base loops located on said sheet at a point closest to the ground for engaging said webbing anchoring strips.

14. The screen according to claim 1, further includes a buckle located on the webbing anchoring strip for tightening the webbing anchoring strip, loosening the webbing anchoring strip and for holding the webbing anchoring strip taut.

15. The screen according to claim 1, having strips of additional material reinforcing the side of said sheet which faces said building.

16. The screen according to claim 1, wherein said sheet is a knitted fabric of uniform open weave and the fabric is selected from the group comprising: polyethylene, polypropylene, vinyl coating mesh, polyester, other polymer base fabrics, laminates and combinations thereof.

17. A screen for protecting a building comprising:

a. a track attachable to an edge of a building; a first edge and a second edge b. a sheet of fabric having first and second opposed edges, and a porosity such that air and light will pass through the fabric;

c. a plurality of nonsliding fixed pins located on the interior of the track channel for engaging in said track and engaging a fastener;

d. webbing strips affixed to said sheet adjacent said first edge of said opposed edges, at a first end and providing loops of webbing strips at a second end;

e. said fastener connected to the loops of webbing strips and removably engagable with the non-sliding pins; and f. webbing anchoring strips secured to said sheet adjacent said second edge attaching to anchoring means.

18. The screen according to claim 17, wherein said sheet is a coarsely woven fabric of uniform open weave and the fabric is selected from the group comprising: polyethylene, polypropylene, vinyl coating mesh, polyester, other polymer base fabrics, laminates and combinations thereof.

19. The screen according to claim 17, wherein the sheet of fabric extends from the edge of the track to the ground.

20. The screen according to claim 17, wherein said webbing anchoring strips are spaced from the edge of said sheet.

21. The screen according to claim 17, wherein said track is a metal angle with holes to accept fasteners to attach the track to the building.

22. The screen according to claim 17, wherein the loops of webbing strips are spaced from the edge of said sheet of fabric.

23. The screen according to claim 17, wherein said building is a house and said track engages a soffit or a facia of said house.

24. The screen according to claim 17, further comprising reinforcing webbing affixed to said sheet to carry load from said non-sliding pins.

25. The screen according to claim 17, wherein said anchoring means are earth or concrete anchors for attaching to said webbing anchoring strips.

26. The screen according to claim 17, wherein a band of reinforcing webbing material covers each fastener.

27. The screen according to claim 17, further comprising a plurality of base loops located on said sheet at a point closest to the ground for engaging said webbing anchoring strips.

28. The screen according to claim 17, further comprising a buckle located on the webbing anchoring strip for tightening the webbing anchoring strip, loosening the webbing anchoring strip and for holding the webbing anchoring strip taut.

29. The screen according to claim 17, having strips of additional material reinforcing the side of said sheet which faces said building.

30. The screen according to claim 17, wherein said sheet is a knitted fabric of uniform open weave and the fabric is selected from the group comprising: polyethylene, polypropylene, vinyl coating mesh, polyester, other polymer base fabrics, laminates and combinations thereof.

* * * * *